United States Patent [19]

van Liefland

[11] Patent Number: 4,828,517

[45] Date of Patent: May 9, 1989

[54] ORION PORTABLE WATERBICYCLE

[75] Inventor: Rudy van Liefland, Wassenaar, Netherlands

[73] Assignee: S.I.R. Service for Innovation Research, Wassenaar, Netherlands

[21] Appl. No.: 15,895

[22] Filed: Feb. 18, 1987

[51] Int. Cl.[4] ..... B63B 1/12; B63H 16/20

[52] U.S. Cl. ..... 440/27; 114/61; 114/345

[58] Field of Search ..... 440/21, 26, 27, 31, 440/29, 30, 90, 91, 92; D12/306; 114/61, 345, 162, 165, 354

[56] References Cited

U.S. PATENT DOCUMENTS

| | | | |
|---|---|---|---|
| 550,522 | 11/1895 | McLachlin | 114/165 |
| 3,593,684 | 7/1971 | Cogliano | 114/61 |
| 4,318,700 | 3/1982 | Price | D12/306 |
| 4,493,658 | 1/1985 | Hildebrand | 440/90 |

FOREIGN PATENT DOCUMENTS

| | | | |
|---|---|---|---|
| 1406192 | 12/1965 | France | 440/26 |
| 8400048 | 8/1985 | Netherlands | 440/27 |

*Primary Examiner*—Joseph F. Peters, Jr.
*Assistant Examiner*—Edwin L. Swinehart
*Attorney, Agent, or Firm*—Ladas & Parry

[57] ABSTRACT

An orion portable waterbicycle in which the main body and various connecting and moving parts are fabricated into standardized components, by means of combination in a way which is simple and fact, the various members can be assembled into the entire waterbicycle in a minimum of time, thus enabling mass production at reduced cost, making it widely acceptable by the public as a fun-making, convenient-to-carry waterbicycle.

4 Claims, 5 Drawing Sheets

ORION PORTABLE WATERBICYCLE

BACKGROUND OF THE INVENTION

The present invention relates to a portable waterbicycle in which the various components can be quickly combined, making it easy to be packed, carried, assembled and disassembled by the user.

Conventional waterbicycles, in most cases, are rented at waterfront recreation areas, because constructed with components that are permanently connected and, therefore, inconvenient to move, as well as more expensive to manufacture. As a result, sightseeing afloat at scenic, but quiet waterfronts, where no waterbicycle rental service is available, is only possible board inflated rubber boats that are carried to the waterfronts by the sightseers.

SUMMARY OF THE INVENTION

It is an object of the invention, therefore, to make the fun of water cycling more widely enjoyable by the public, and to make the waterbicycles less costly and more portable.

To this end, the main body and various driving mechanisms of a waterbicycle according to the invention are standardized components to facilitate mass production. All the components are designed for simple and fast combination, so they can be packed in a volume that is easy to carry and assembled and disassembled in a minimum of time, thus making the waterbicycle of the invention good for leisure and recreational activities and adding to the fun of life.

Therefore, the main body and driving mechanism components are each dimensioned such that the waterbicycle may be disassembled and packed into a compact bag or the like suitable to move and carry. These components also are configured for quick assembly. Assembly into a completed waterbicycle can be done, in a short period of time, so that the owner can enjoy the fun afloat everywhere as one of his favorite leisure activities.

BRIEF DESCRIPTION OF THE DRAWINGS

The structure of an embodiment of the invention and the assembling and disassembling thereof will now be described in conjunction with the following drawings, in which.

DETAILED DESCRIPTION OF THE EMBODIMENT

Figure 1:
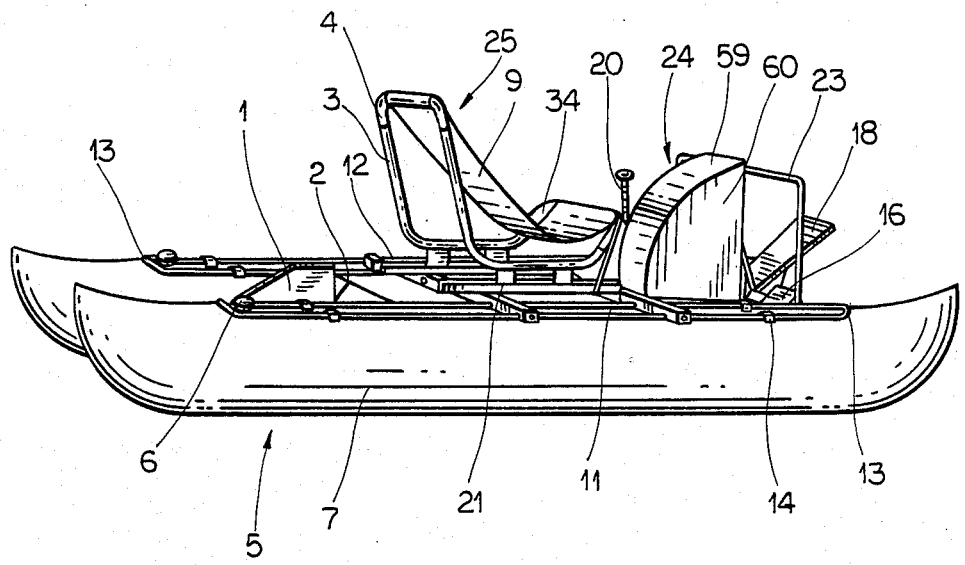
FIG. 1 is an overall side/rear perspective view of the embodiment.
Figure 2:
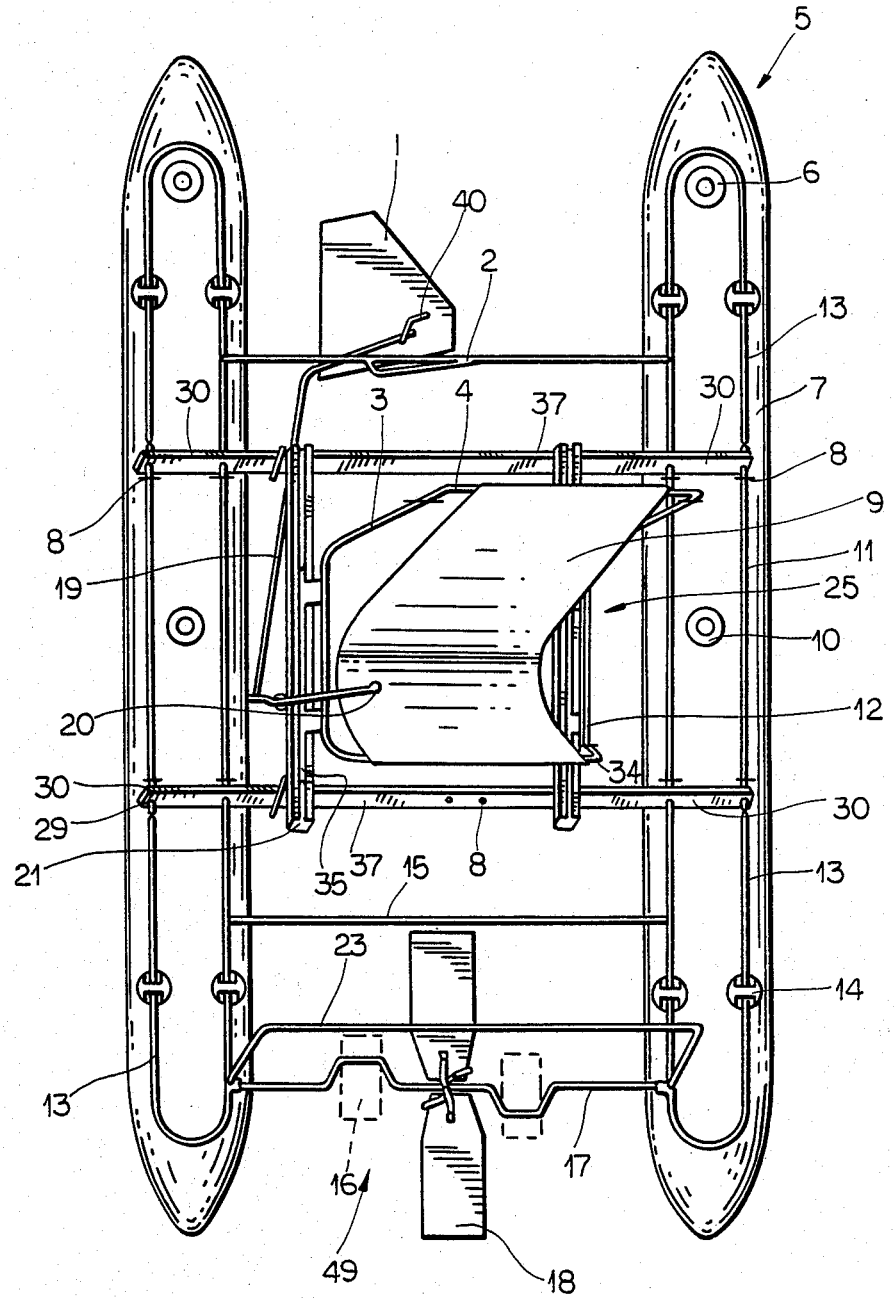
FIG. 2 is a top/side perspective view of the embodiment with a waterguard rewoved.
Figure 3:
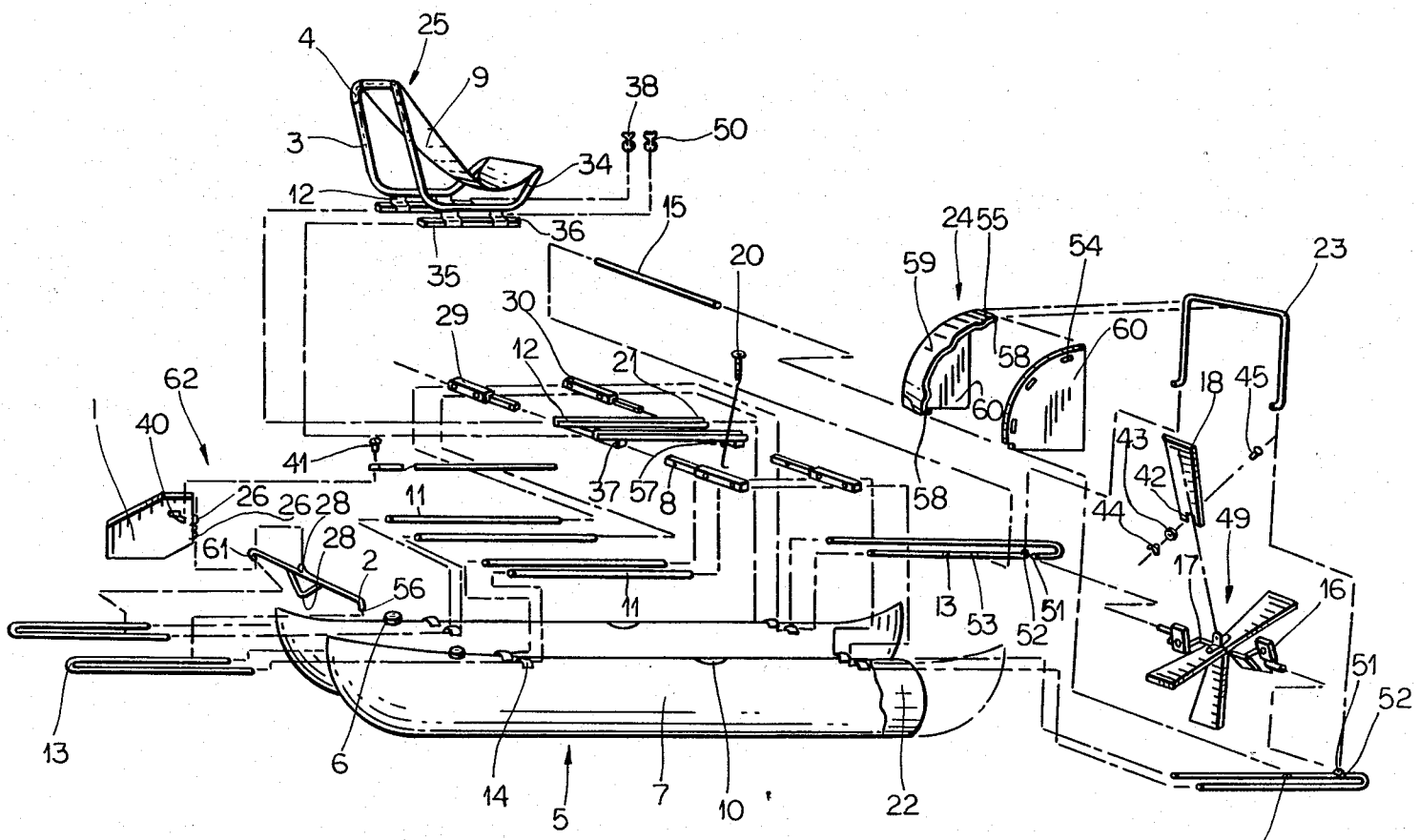
FIG. 3 is an exploded side/rear perspective view of the embodiment.

Referring to FIGS. 1, 2 and 3, an embodiment of the invention is composed of float at 5, a chair at 25, a propelling device at 49, and a steering mechanism at 62. Each of these components is capable of being quickly disassembled into a plurality of subparts to facilitate packaging and carrying.

There are two tubular parallel floats at 5, each made of a plastic material having, in juxtaposed arrangement, an outer tube 7 and an inner tube 22. The top portion of each float is provided with an inner tube valve 10 and an outer tube valve 6 which communicate with the inner and outer tubes for inflation. The floats are further provided with retaining rings 14 on opposite ends of an upper portion thereof into which four U-shaped frame tubes 13 are respectively inserted. The U-shaped frame tubes 13 are then fitted to straight frame tubes 11 by having both ends of each of the straight frame tubes 11 formed into narrowed portions 33 having a fixed leaf spring 32 and a tubular fitting 8 for connection to the respective U-shaped frame tubes 13 by fitting into holes on the U-shaped frame tubes 13.

The chair at 25 comprises a chair frame tube 3 with leg tubes 35 secured to the bottom portion thereof. The leg tubes are hollow square-cross-section tubes. A stud 36 projects from one end of each leg tube. The top, projecting-end portion of each stud 36 is threaded. Opposite ends of the chair frame tube 3 are U-shaped to form a back tube 4 and a chair seat tube 34, respectively. The back tube 4 and the seat tube 34 support a chair runner 9. Chair rails 21 receive the leg tubes 35. The chair rails 21 are supported on transverse tube supports 37. Connecting tubes 30 are on the ends of the tube supports 37. Each connecting tube 30 is provided with two holes 29 into which ends of the U-shaped frame tubes 13 are inserted, respectively, so that the chair rails 21 are mounted on the floats 5. The chair rails 21 are hollow and slotted with slots 12 so the leg tubes 35 can be inserted thereinto for sliding along the chair rails 21. The leg tubes 35 are fixed in the chair rails 21 by the stud 36, which has a washer 50 and a butterfly nut 38 on its threaded top portion for this. When a change of position of the chair 25 is desired, it can be effected by loosening the nut 38, sliding the chair 25 to a suitable position on the rails 21 and re-fixing it by re-tightening the nut 38. However, the connecting tubes 30 tend to move along the U-shaped frame tubes 13 because of the force of reaction produced while pedals 16 (later described) are being pedaled, but, due to the body weight of the cyclist on the chair 25 and, thus, the connecting tubes 30, the friction force between the connecting tubes 30 and the U-shaped frame tubes 13 is significantly greater than the reaction or drag force on the floats 5 as they glide over the water, so that, therefore, the chair 25, is, in fact, maintained stable while the cyclist is pedaling.

Figure 5:
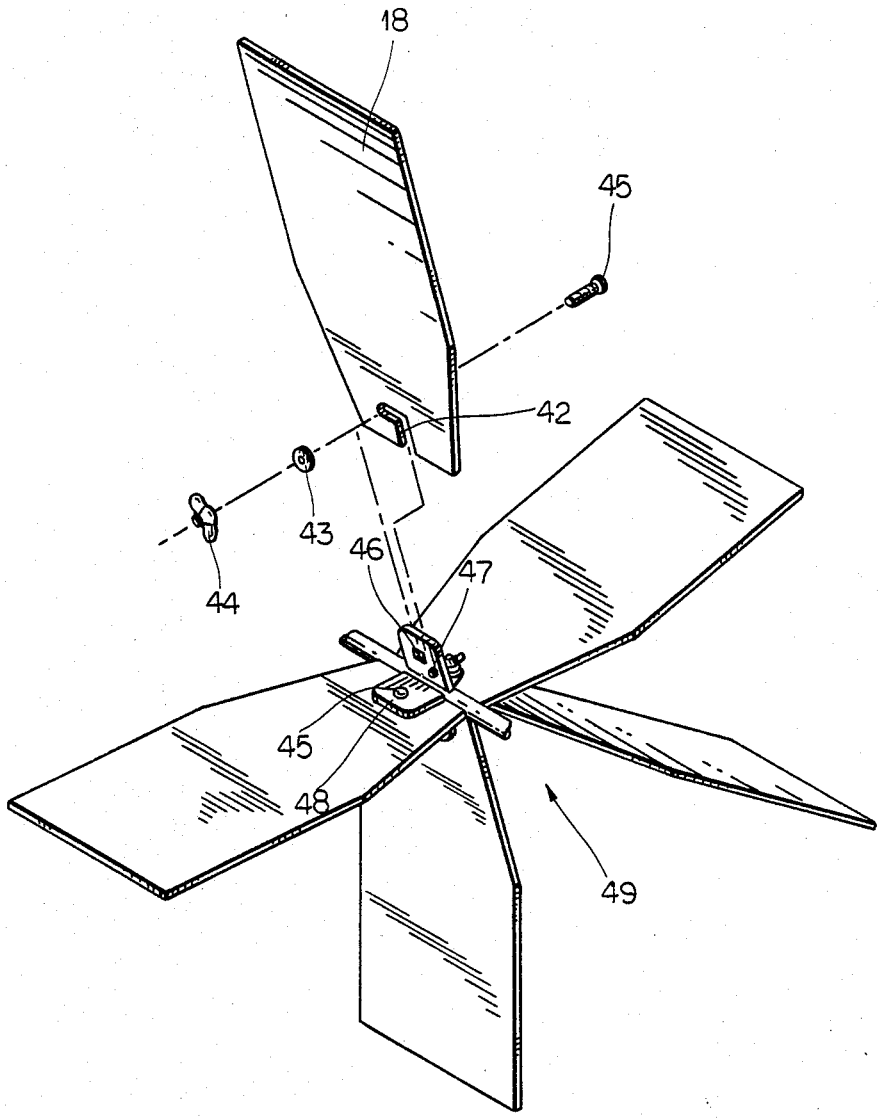
FIG. 5 is a side/top perspective view, partly exploded, of a propelling mechanism of the embodiment.

The propelling device at 49 (FIGS. 2, 3, 5) will now be described. A plurality of connecting plates 48 radially project from a pedal axle 17. Each of the plates 48 is provided with a hole 46 and a stud 47 (only one each shown in FIG. 5), and each of complementary impeller blades 18 is provided with a complementary retaining groove 42. In mounting the impeller blades 18 respectively on the plates 48, the studs 47 are fitted into the respective retaining grooves 42, and then respective screws 45 are inserted through the holes 46 and the retaining grooves 42 for securing the plates and blades together with a washer 43 and a butterfly nut 44 on each screw. Pedals 16 are rotatably mounted on the paddle axle 17. Both, opposite ends of the paddle axle 17 are then rotatably mounted, respectively, in holes 51 (FIG. 3) on the sides of two, respective U-shaped frame tubes 13.

A waterguard at 24 (FIGS. 1 and 3) partly covers at least the impeller blades of the propelling device and comprises of a face plate 59 and two side plates 60 having grooves 54 fitting onto projection pieces 55 on the sides of the face plate 59. The inner sides of both, opposite ends of the face plate 59 are each provide with curved portions 58, which fit onto a waterguard bar 23 and rod 15. Opposite ends of the waterguard bar 23 are bent to be inserted, respectively, into the holes 52 in the two of the U-shaped frame tubes (13). Both, opposite ends of the rod 15 also are fitted, respectively, into holes 53 in the same U-shaped frame tubes 13.

Referring to FIGS. 3 and 4, particularly, the steering mechanism at 62 generally includes a rudder 1, a rudder quadrant or connecting arm 40, a rudder bridge 2, a rudder connecting rod 19, and a securing handle 20. The rudder 1 is secured to the connecting arm 40 and, at one edge, to two sleeves (gudgeons) 26. The sleeves are fitted onto two studs pintles) 28 provided on the rudder bridges 2. One end of the bridge 2 is a curved end 61, which can be fitted into a hole in another of the U-shaped frame tubes 13, and the other, opposite end is a bent end 56, which can be secured by pressing into a hole in a massive plug 31 provided in the last U-shaped frame tube 13. One end of the rudder connecting rod 19 is secured to the rudder quadrant 40 by a long peg 41 so that the rudder 1 is pulled to pivot about the studs 28. The other end of the rod 19 is connected to a hook on one, lower end of the steering handle 20. A stud (not shown) is provided on the side of the steering handle 20 for insertion into a sleeve 57 secured to the underside of one of the chair rails 21 and securing by tightening a nut (not shown) onto threads (not shown) of the stud for pivotably mounting the steering handle on the chair. Therefore, the steering handle 20 will move the rudder 1 to change the course of the waterbicycle at the pull of the cyclist on the steering handle 20.

From the foregoing, it is apparent that the present invention is convenient to carry, easy to assemble and such that mass production of the waterbicycle is possible, thereby making the present invention readily acceptable to the public for more fun in leisure living.

The above embodiment is for example only, and not to limit the invention. It is intended that the claims cover all variations and modifications which can be made without departing from the spirit and scope of the invention.

I claim:

1. A portable waterbicycle, comprising:

a pair of parallelly disposed floats with frame tubes attached thereon being connected by two supports in such a way that the frame tubes pass through the supports;

a chair assembled by chair tubes being optionally positioned on rails secured on said supports;

a propelling device comprising a plurality of connecting plates radially fixed on an axle, each of the connecting plates being mounted with an impeller blade, and a pedal pivotally mounted, respectively, to both left and right sides of said axle, while both ends of the axle being pivotally secured into said float frame tubes;

a waterguard comprising a face plate and two side plates partially covering said propelling device, ends of the face plate and the side plates being fitted in position on a waterguard bar and a rod, respectively, the waterguard bar and the rod being fixed on the float frame tubes;

a steering mechanism comprising a rudder pivotally fixed at a central portion of a rudder bridge secured to the float frame tubes, said rudder being connected by a rudder quadrant to a rudder connecting rod which is in turn connected to a steering handle movably secured to said chair.

2. The portable waterbicycle according to claim 1, wherein each of the connecting plates of the propelling device is provided with a hole and a stud, and each of the impeller blades is provided with a retaining groove, thereby the stud may be fitted into the groove and a screw may be inserted through said hole and said groove for securing the impeller blades onto the connecting plates.

3. A portable waterbicycle, comprising:

two, tubular, parallel floats;

frame tubes on each of the floats;

chair means on at least one of the frame tubes on each of the floats for forming a chair and supporting the chair on the frame tubes;

propelling means for propelling the floats in water, the propelling means comprising a paddle axle rotatably mounted at opposite ends on at least one of the frame tubes on each of the floats, a plurality of connecting plates radially projecting from the pedal axle, impeller blades, connecting means for connecting the impeller blades respectively to the connecting plates, and pedals rotatably mounted on the pedal axle;

a waterguard for partly covering at least the impeller blades of the propelling device, the waterguard comprising a face plate, said plates on sides of the face plate, a waterguard bar and a rod each having opposite ends on at least one of the frame tubes on each of the floats, means on opposite ends of the face plate respectively for fitting onto the waterguard bar and rod; and steering means for steering the floats when propelled in the water, the steering means comprising a rudder bridge having opposite ends on at least one of the frame tubes on each the floats, a rudder, sleeve and stud means for pivotally mounting the rudder on the rudder bridge, a rudder quadrant on the rudder, a steering handle pivotally mounted on the chair; and a rudder connecting rod connecting one end on the steering handle to the rudder quadrant for pivoting the rudder by pulling the steering handle.

4. The portable waterbicycle according to claim 3, wherein the connecting means of the propelling means comprises holes respectively through the connecting plates, studs respectively on the connecting plates, retaining grooves respectively in the impeller blades for respectively receiving the studs of the connecting plates when the impeller blades are respectively connected to the connecting plates, screws respectively inserted through the holes and retaining grooves of the connecting plates and impeller blades when connected, and nuts respectively on the screws for securing the respective impeller blades and connecting plates together.

* * * * *

UNITED STATES PATENT AND TRADEMARK OFFICE

CERTIFICATE OF CORRECTION

PATENT NO. : 4,828,517

DATED : May 9, 1989

INVENTOR(S) : RUDY VAN LIEFLAND

Figures 4A, 4B:
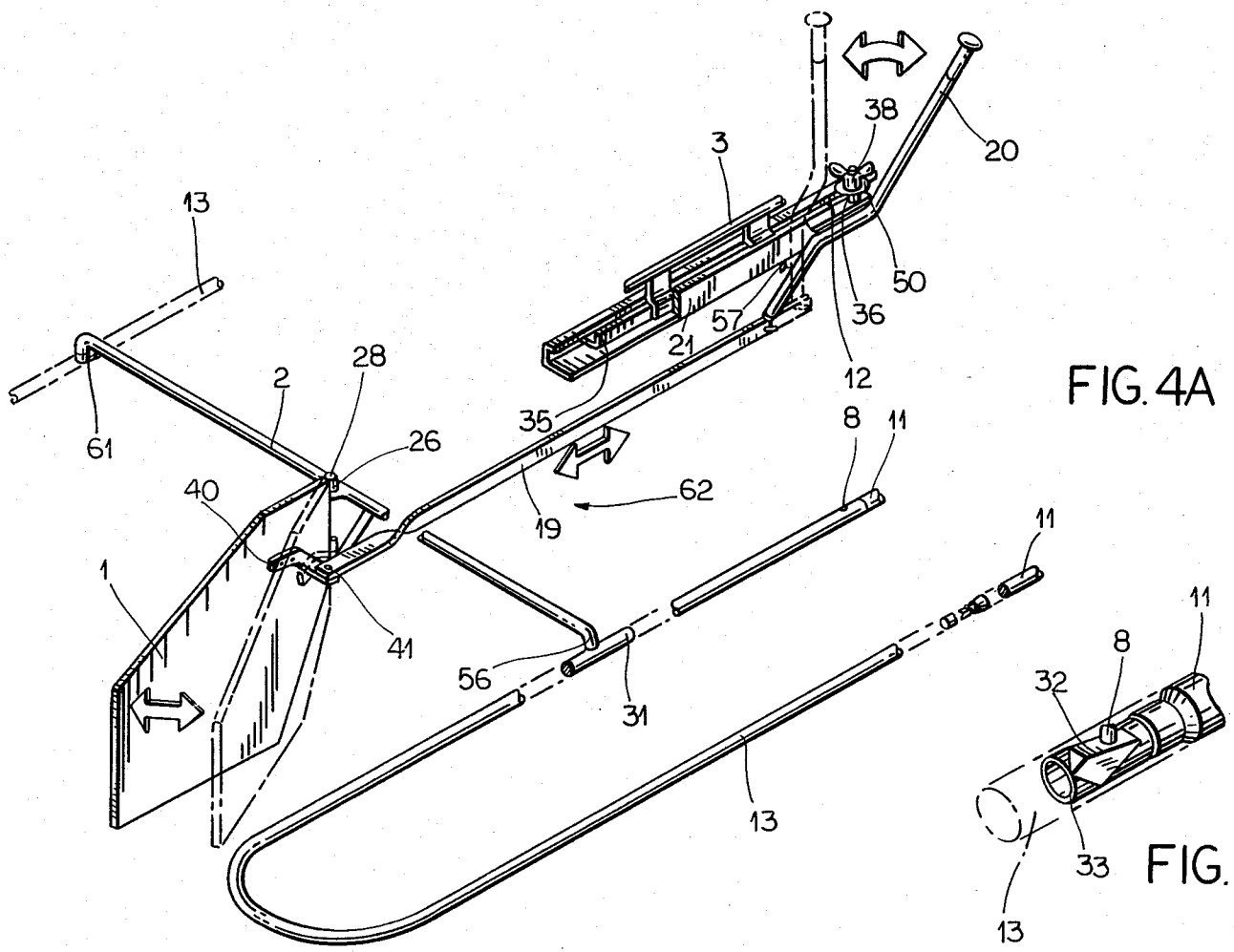
FIG. 4 is a side/rear perspective view of a steering mechanism of the embodiment.

It is certified that error appears in the above-identified patent and that said Letters Patent is hereby corrected as shown below:

Column 1, line 54, after "4" insert -- a -- and line 55, after "embodiment;" insert a new paragraph -- Fig. 4b is an enlarged perspective view of a portion of the embodiment of Fig. 4a; --.

Column 2, line 9, after "11" insert -- , as shown in Fig. 4b, --.

Column 3, line 10, after "4" insert -- a --.

Signed and Sealed this

Twenty-sixth Day of June, 1990

*Attest:*

*Attesting Officer*

HARRY F. MANBECK, JR.

*Commissioner of Patents and Trademarks*